US005375940A

United States Patent [19]

Kobayashi

[11] Patent Number: 5,375,940

[45] Date of Patent: Dec. 27, 1994

[54] WATER PERMEABLE LANDSCAPE DITCH COVER

[75] Inventor: Fumiki Kobayashi, Mie, Japan

[73] Assignee: Chubu Industries, Inc., Kuwana, Japan

[21] Appl. No.: 15,481

[22] Filed: Feb. 9, 1993

[51] Int. Cl.[5] ..... E02B 11/00

[52] U.S. Cl. ..... 404/2; 404/4; 404/5; 404/3; 404/24; 52/19; 52/20

[58] Field of Search ..... 404/2, 4, 5; 404/24, 25; 210/163, 164, 170, 293; 52/11-16; 405/38, 39, 42, 45

[56] References Cited

U.S. PATENT DOCUMENTS 4,564,310 1/1986 Thelen et al. ..... 404/31
4,589,798 5/1986 Milly ..... 210/164
4,621,939 11/1986 Thomann et al. ..... 404/4
4,973,191 11/1990 Dannhäuser ..... 404/25
5,030,343 7/1991 Urriola ..... 405/43
5,223,154 6/1993 MacPherson, Jr. et al. ..... 404/2
5,282,691 2/1994 McIntosh et al. ..... 405/45

FOREIGN PATENT DOCUMENTS 1634026 10/1970 Germany .

*Primary Examiner*—Ramon S. Britts
*Assistant Examiner*—Pamela Anne O'Connor
*Attorney, Agent, or Firm*—Fulbright & Jaworski

[57] ABSTRACT

A water permeable landscape ditch cover comprising a monolithic body with a paved, water permeable surface comprised of a aggregate material and a synthetic resin binder.

14 Claims, 2 Drawing Sheets

WATER PERMEABLE LANDSCAPE DITCH COVER

FIELD OF THE INVENTION

The present invention relates to a ditch cover or a catch-basin cover to be placed over a gutter or a drainage ditch along a road or in a park.

PRIOR ART

Generally, gutters provided on the sides of roads, and catch basins or drainage ditches in parks, covers, and usually lattice covers made of concrete or cast iron or steel frames are used as the ditch covers or catch-basin covers. A function required of a ditch cover or a catch-basin cover is to provide a safe passage for pedestrians or vehicles as well as smooth drainage. Also, such covers require a weight to facilitate opening or closing.

In case of a concrete cover, however, the weight is generally heavy, but the strength and the drainage performance are rather inadequate. In addition, it is necessary to provide water holes on the concrete base plate. On the other hand, in case of a cast iron lattice cover or a steel frame, the strength and the drainage performance are adequate, but the crevices are large, which causes troubles for pedestrians' safety. For the reasons as described above, cast iron lattice covers or steel gratings having small crevices, or so-called the small-crevice type of covers have been devised and used.

In any case, the cast iron lattice covers or steel gratings as described above, and the so-called small-crevice type of covers have crevices. Refuse, fallen leaves, cigarette ends, other foreign materials drop into the ditch through the crevices and are piled up there to prevent water from being drained smoothly so that cleaning must be carried out periodically. Further, high-heeled shoes may be caught in the crevices, which may injure the pedestrian and is dangerous. In addition to the foregoing problems of effectiveness and safety, it is difficult to manufacture the small-crevice type of covers, which is a defect of this type of cover.

An object of the present invention is to provide a water permeable landscape ditch cover or a catch-basin cover to be used for covering a gutter or a drainage ditch for a road or in a park with a relatively light weight which can solve the defects as described above and insure a safe passage for vehicles and pedestrians as well as smooth drainage, and also which prevents refuse or other foreign materials from dropping into a ditch and can be cleaned easily.

SUMMARY OF THE INVENTION

In order to achieve the aforesaid object, the water permeable landscape ditch cover of the present invention comprises a steel frame having a strength enough to respond to various weight conditions, a steel plate having water holes to support water permeable resin mortar on it, and water permeable resin mortar used to pave the surface of the steel plate.

Each component of the steel frame must endure a design load specified for conditions in use, water permeable resin mortar comprising a mixture of aggregate and synthetic resin binder is filled over the top surface of the steel plate to pave said steel plate with the surface finished to a nearly smooth state, and the surface is adjusted to the same level as top edges of side plates surrounding a periphery of the steel frame.

The water permeable resin mortar comprises a mixture of aggregate with a granule diameter of 10 mm or less and synthetic resin binder, or a mixture made by mixing and kneading aggregate with a granule diameter of 10 mm or less and soft granule with the same granule diameter together with synthetic resin binder. A suspended metallic component having a screw hole with a machine screw set in the screw hole to block the top face is supported by a main beam of the steel frame and buried into the water permeable resin mortar pavement with the top surface adjusted to the same level as the surface of said water permeable resin mortar pavement so that, when the ditch cover is opened or closed after installation, the ditch cover can easily be removed or replaced by removing the machine screw and screwing a screw section of a handle tool shaft into the screw hole. Such materials as gravel which can be obtained at the seashore or at the mouth of river, various types of debris, slug from a blast furnace or a converter, and broken stone are employed as materials for the aggregate which is used as the water permeable resin mortar. Such materials as rubber chips or urethane chips are employed for the soft aggregate. A comfortable feeling during walking over the cover can be obtained by blending the materials as described above into aggregate. On the other hand, such materials as urethane, epoxy, polyester, and acryl are employed for the synthetic resin binder, and a porosity from 18 to 30% can be obtained by setting the mixing ratio of aggregate to water permeable resin mortar in weight base as follows;

Aggregate :Synthetic resin binder=100:2–6

Aggregate: Soft aggregate: Synthetic resin binder=30:10:2–6 which insure an adequate drainage performance because there are a number of crevices within the layer.

The water permeable landscape ditch cover having the construction as described above is usually set in a receiving frame installed over a gutter or a drainage ditch along a road or in such places as a park. The height of the water permeable landscape drainage ditch is adjusted according to load conditions required at a place of use, and the height of side plates surrounding the periphery is adjusted to the same level as the surface of the water permeable resin mortar pavement, so that the cover gives no trouble to pedestrians.

The surface of a steel plate used for the steel frame having water holes on it, or surface of water permeable resin mortar filled in the steel frame to pave the steel plate via, for instance, a punching metal sheet, is finished to a nearly smooth state by loading an appropriate pressure to the surface. The water permeable resin mortar is bound with a mixture of aggregate having a granule diameter of 10 mm or less and synthetic resin binder mixed therein, so that there are a number of crevices, which allows for only water to pass through, between the aggregate and the synthetic resin binder. Thus, not even the heels of high-heeled shoes may be caught in the crevices of the cover of the present invention. Furthermore, rain water or other type of water passes through the crevices within the water permeable resin mortar layer and then through water holes on the punching metal sheet, and flows into a gutter or a drainage ditch from a large clearance under the steel frame, thus being drained.

DETAILED DESCRIPTION OF THE PREFERRED EMBODIMENTS

Figure 1:
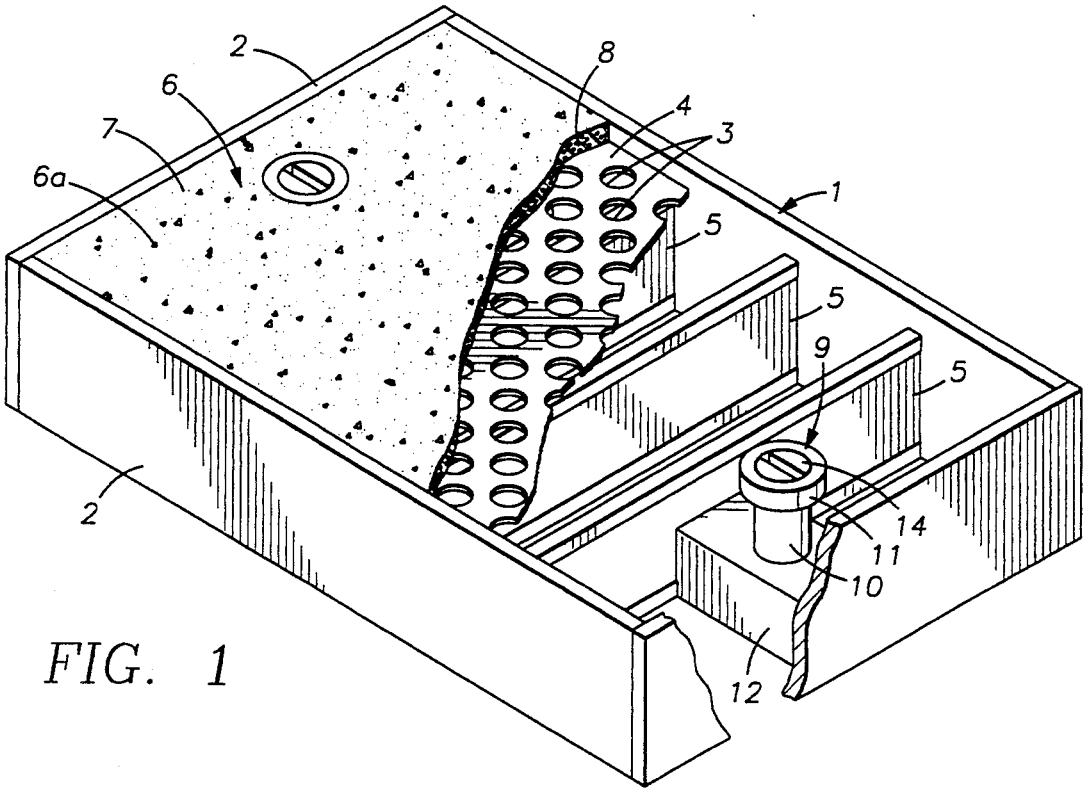
FIG. 1 is a partially lacked perspective view of first embodiment of a water permeable landscape ditch cover according to the present invention.

Description is made hereinafter with reference to related drawings, and in FIG. 1 a water permeable landscape ditch cover according to the present invention comprises a steel frame 1 having strength enough to respond to various types of load conditions and surrounded by side plates 2, a steel plate 4 having water holes 3 in the top surface, and water permeable resin mortar 6 used to pave the surface of the steel plate 4.

Figure 2:
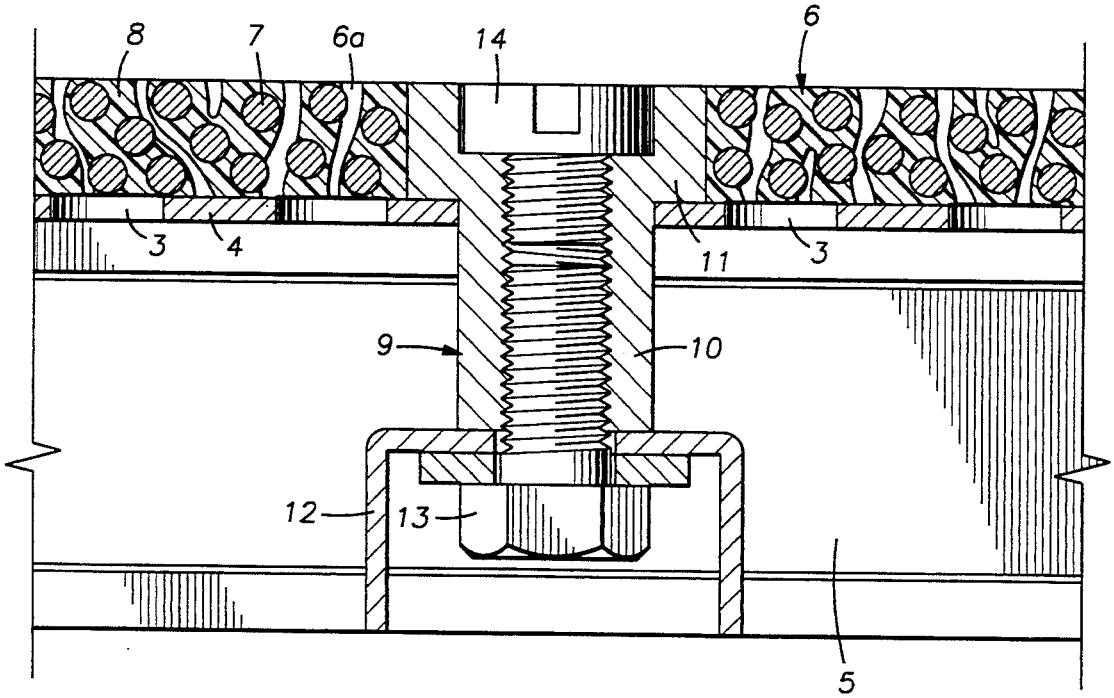
FIG. 2 is a partially enlarged cross section of the ditch cover depicted in FIG. 1.

In FIGS. 1 and 2, the aforesaid steel frame 1 with the periphery surrounded by side plates 2 comprises a steel plate 4 having the water holes as described above and horizontally positioned inside the steel frame 1 at a depth of at least 10 mm from the top edge of the side plate 2 and main beams 5, the number of which is adjusted so that an appropriate clearance is maintained along the side plate according to a strength required at a place of use. As the steel plate 4 having water holes 3, a punching metal sheet is suitable.

The water permeable resin mortar comprises a mixture of aggregate 7 having a granule diameter from 1 to 8 mm and synthetic resin binder 8. The mortar may also be made by mixing the aggregate 7 having a diameter from 1 to 8 mm, a soft aggregate having the same diameter, and the synthetic resin binder 8.

Materials such as gravel which can be obtained at the seashore or at the mouth of a river, various types of debris, slug from a blast furnace or a converter, and broken stone are employed for the aggregate used as the water permeable resin mortar, and are selected according to the requirements for a place of use or for other conditions. Especially when natural stone is used for that purpose, the stone can provide an appearance suited to the surrounding landscape. On the other hand, various materials such as rubber chips or urethane chips are employed for the soft aggregate, and a flexibility insuring a comfortable feeling during walking over the cover is provided by blending the soft aggregate with the aggregate.

A material such as urethane, epoxy, polyester, or acrylic resin is employed as the synthetic resin binder, and a porosity from 18 to 30% can be obtained by setting the mixing ratio of aggregate 7 a synthetic resin binder in weight base as follows;

Aggregate: Synthetic resin binder = 100:2–6

Aggregate: Soft aggregate: Synthetic resin binder = 30:10:2–6 which insures an adequate drainage performance because there are a number of crevices within the layer.

FIG. 2 is a partially enlarged view of FIG. 1 showing details of a suspended metallic component 9 in the steel frame 1, and said suspended metallic component has a jaw section 11 to form a concave section in the upper part of a basic body 10 of a cylindrical body with a female screw cut in the internal surface, and a machine screw 14 to block said female screw hole is set in said concave section. On the other hand, between the side plate 2 near one end of the steel frame 1 and the main beam 5 is attached a groove-formed metallic support 12 with a through-hole drilled at the center to support the suspended metallic component which is placed on the metallic support, and the suspended metallic component 9 is placed on said metallic support 12 by inserting it into the upper section from the through-hole near one edge of steel plate 4, a setting bolt 13 is screwed into a screw hole of a basic body 10 of the suspended metallic component 10 to make the bottom face of the jaw edge 11 closely contact the top face of the steel plate 4 for fixing the suspended metallic component 9 as well as to adjust the top face of the suspended metallic component 9 to the same level as the top edge of the side plate 2 and the surface of the water permeable resin mortar pavement.

As the top edge of the side plate 2 and the surface of the water permeable resin mortar are adjusted to the same horizontal level, and also as a thickness of each component of the steel frame is adjusted to load conditions at a place of use such as a road or a park, no trouble is given to pedestrians, nor to vehicles.

Figure 3:
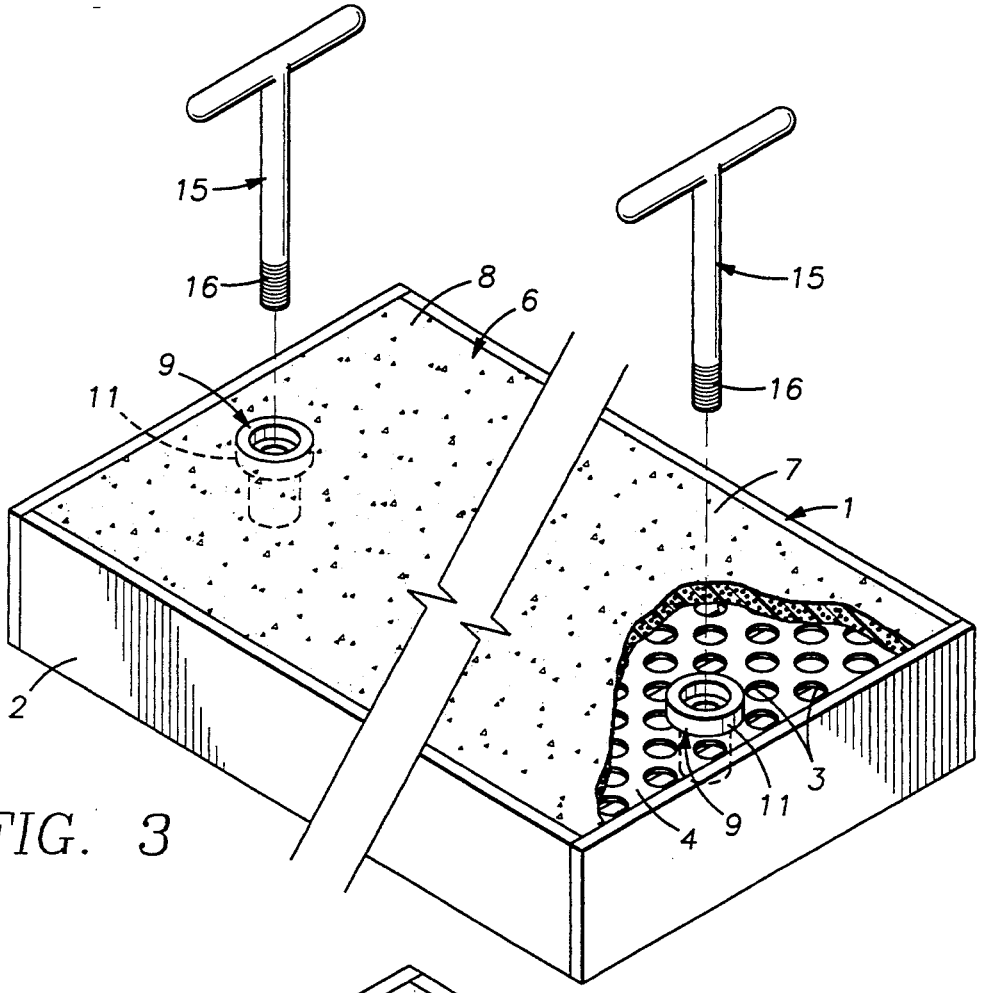
FIG. 3 is a partially lacked perspective view of a second embodiment of one embodiment of a water permeable ditch cover according to the present invention.

FIG. 3 shows one embodiment of a lengthy water permeable landscape ditch cover and a tool used to open or close a water permeable landscape ditch cover placed over a drainage ditch, and in case of the lengthy ditch cover as shown in FIG. 3, the aforesaid suspended metallic components 9 are provided at both end sections of the ditch cover in the longitudinal direction thereof.

Figure 4:
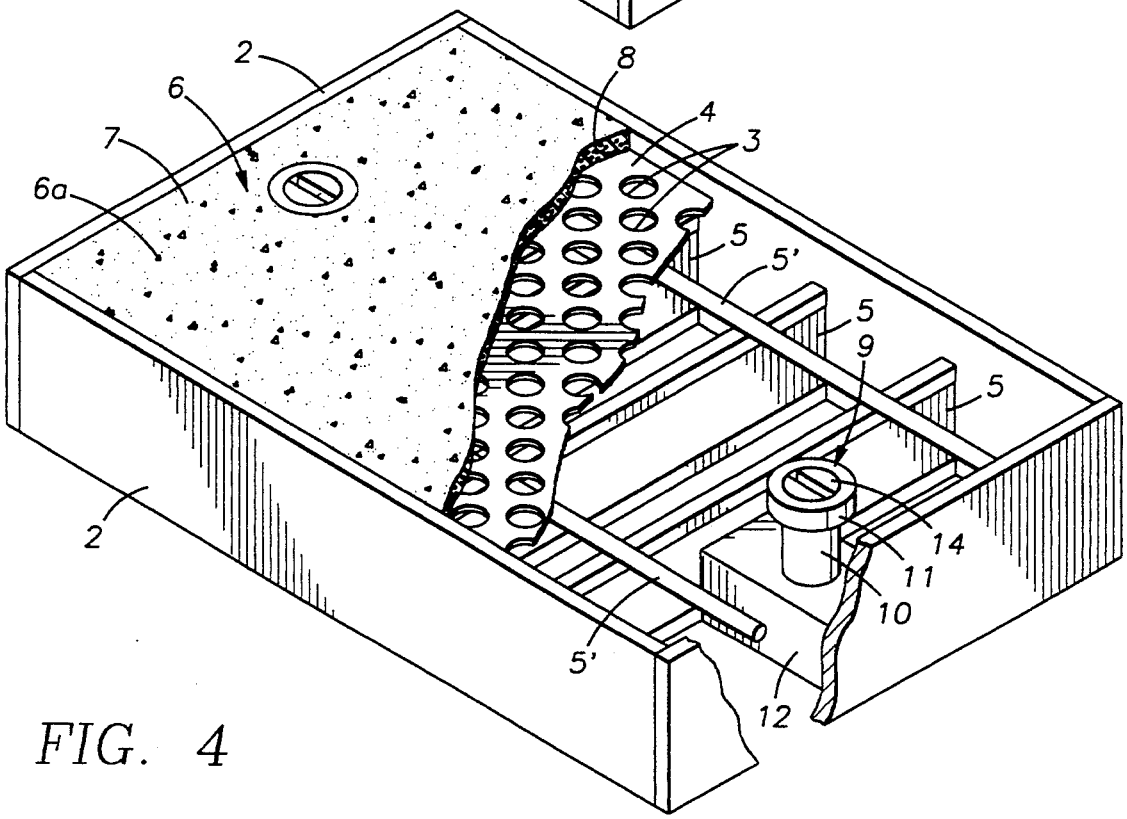
FIG. 4 is a partially lacked perspective view of a third embodiment of a water permeable landscape ditch cover in accordance with the present invention.

FIG. 4 shows a construction of a water permeable landscape ditch cover according to the present invention combined with a steel grating, comprising the side plates 2 provided at the periphery, an appropriate number of joints or traverse beams 5' at right angles against the main beams 5 provided at a space inside the frame to form a lattice form, the punching metal sheet 4 provided on the top face of so-called the steel grating, and water permeable resin mortar pavement on the surface of the punching metal sheet 4.

The water permeable landscape ditch cover once placed can easily be removed or placed again by removing 1 or 2 machine screws 14 being exposed from the surface of the pavement by the water permeable resin mortar 6 with a tool, screwing a screw section 16 of a T-shaped handle 15 into a screw hole of a basic body of the suspended metallic component 9, and then raising the ditch cover.

As the surface of the water permeable resin mortar is finished to a smooth state, pedestrians with high-heeled shoes can walk over the ditch cover comfortably and safely. In addition, rain water or any other type of water passes through crevices formed in the water permeable resin mortar and is drained from water holes 4 of the steel plate 5 or holes of the punching metal sheet into a drainage ditch.

The water permeable landscape ditch cover according to the present invention is a monolithic body made by paving the top surface of the steel frame via a steel plate having water holes with water permeable resin mortar comprising a mixture of aggregate and synthetic resin binder, adjusting the surface of the pavement to the same level as the top edge of the side plates for the steel frame, and finishing the surface into a smooth state, so that the water permeable resin mortar layer may be relatively thin, which gives an economical advantage, and in addition the ditch cover having a light weight and a strength enough to respond to various load conditions at a place of use can be produced at a lower cost as compared to the conventional concrete or steel products. Furthermore, products well suited to the surrounding landscape can be obtained by selecting an appropriate natural material for aggregate for the water permeable resin mortar used for pavement.

Also, a high drainage performance is insured because rain water or any other type of water is drained from crevices in the water permeable resin mortar layer and water holes of the steel plate, a comfortable feeling for waking and a non-slip effect are obtained by mixing soft aggregate in the water permeable resin mortar, the water permeable resin mortar is not separated and heels of shoes are not caught by the pavement because the top edge of the steel frame is adjusted to the same level as the surface of the water permeable resin mortar, and other effects including the fact that vehicles and pedestrians in high-heeled shoes can pass over the ditch cover when placed over a gutter along a road or a drainage ditch in a park are provided.

Explanation of Signs

1. Steel frame
2. Side plate
3. Water hole
4. Steel plate or punching metal sheet having water holes
5. Main beam
5' Joint or traverse beam
6. Water permeable resin mortar
6a. Crevice
7. Aggregate
8. Synthetic resin binder
9. Suspended metallic component
10. Basic body of suspended metallic component
11. Jaw edge
12. Metallic support
13. Setting bolt
14. Machine screw for blocking a screw hole

I claim:

1. A water permeable ditch cover comprising:

a metal frame defined by side plates having top and bottom edges;

a plurality of spaced beam members extending transversely between a pair of opposed side plates; the beam members having top surfaces spaced below the top ledges of each side plate;

metal support means traversing the side plates and being disposed on the top surface of the beam members, the metal support means having a top side; and water permeable resin mortar paved smoothly across the top side of the metal support means, the mortar comprising a mixture of granular aggregate and synthetic resin binder.

2. The apparatus of claim 1 in which the metal support means comprises a punching metal sheet.

3. The apparatus of claim 1 in which the granular aggregate as about 1 to 8 mm in diameter.

4. The apparatus of claim 1 in which the aggregate is selected from the group consisting of gravel, blast furnace slug, broken stone, rubber chips, and urethane chips and the synthetic resin binder is selected from the group consisting of urethane, epoxy, polyester, and acrylic resin.

5. The apparatus of claim 3 in which the aggregate is selected from the group consisting of gravel, blast furnace slug, broken stone, rubber chips, and urethane chips and the synthetic resin binder is selected from the group consisting of urethane, epoxy, polyester, and acrylic resin.

6. The apparatus of claim 1 having at least one receptacle extending from the top of the metal support means, the receptacle defining a threaded passageway for receiving a tool for lifting the ditch cover.

7. The apparatus of claim 2 having at least one receptacle extending from the top of the metal support means, the receptacle defining a threaded passageway for receiving a tool for lifting the ditch cover.

8. The apparatus of claim 3 having at least one receptacle extending from the top of the metal support means, the receptacle defining a threaded passageway for receiving a tool for lifting the ditch cover.

9. The apparatus of claim 1 having adjusting means for adjusting the height of the metal support means.

10. The apparatus of claim 6 having adjusting means for adjusting the height of the metal support means.

11. The apparatus of claim 9 in which the adjusting means comprises a receptacle extending from the metal support means, the receptacle defining a threaded passageway, and a setting bolt adjustably screwed into the receptacle.

12. The apparatus of claim 10 in which the adjusting means comprises a receptacle extending from the metal support means, the receptacle defining a threaded passageway, and a setting bolt adjustably screwed into the receptacle.

13. The apparatus of claim 5 having adjusting means for adjusting the height of the metal support means.

14. The apparatus of claim 12 in which the adjusting means comprises a receptacle extending from the metal support means, the receptacle defining a threaded passageway, and a setting bolt adjustably screwed into the receptacle.

* * * * *

UNITED STATES PATENT AND TRADEMARK OFFICE

CERTIFICATE OF CORRECTION

PATENT NO. : 5,375,940

DATED : December 27, 1994

INVENTOR(S) : Kobayashi

It is certified that error appears in the above-indentified patent and that said Letters Patent is hereby corrected as shown below:

Column 1, line 34: after "ends," insert --and--.
Column 2, line 32: ";" should read --:--.
Column 3, line 58: "a" should read --to--.
Column 3, line 59: ";" should read --:--.
Column 4, lines 40, 43 and 58; Column 5, line 29; Column 6, line 6: each occurrence of "punching" should read --punched--.
Column 6, line 9, cancel beginning with "4. The apparatus of claim 1" to and including "acrylic resin." in column 6, line 20, and insert the following claims:

4. The apparatus of claim 1 in which the aggregate is selected from the group consisting of gravel, blast furnace slug, and broken stone, and the synthetic resin binder is selected from the group consisting of urethane, epoxy, polyester, and acrylic resin.

5. The apparatus of claim 3 in which the aggregate is selected from the group consisting of gravel, blast furnace slug, and broken stone, and the synthetic resin binder is selected from the group consisting of urethane, epoxy, polyester, and acrylic resin.

Column 6, lines 26-27: "metal support means" should read --punched metal sheet--.

UNITED STATES PATENT AND TRADEMARK OFFICE

CERTIFICATE OF CORRECTION

PATENT NO. : 5,375,940

DATED : December 27, 1994

INVENTOR(S) : Kobayashi

It is certified that error appears in the above-indentified patent and that said Letters Patent is hereby corrected as shown below:

Column 6, line 33, cancel beginning with "9. The apparatus of claim 1" to and including "receptacle." in column 6, line 53, and insert the following claims:

9. The apparatus of claim 7 having adjusting means for adjusting the height of said at least one receptacle.

10. The apparatus of claim 6 having adjusting means for adjusting the height of said at least one receptacle.

11. The apparatus of claim 9 in which the adjusting means comprises a threaded setting bolt adjustably screwed into the receptacle.

12. The apparatus of claim 10 in which the adjusting means comprises a threaded setting bolt adjustably screwed into the receptacle.

13. The apparatus of claim 8 having adjusting means for adjusting the height of said at least one receptacle.

14. The apparatus of claim 13 in which the adjusting means comprises a threaded setting bolt adjustably screwed into the receptacle.

15. The apparatus of claim 1 wherein said mixture further comprises a soft aggregate.

16. The apparatus of claim 15 wherein said soft aggregate is selected from a group consisting of rubber chips, and urethane chips and the synthetic resin binder is selected from the group consisting of urethane, epoxy, polyester, and acrylic resin.

Signed and Sealed this

Fourteenth Day of November, 1995

*Attest:*

Bruce Lehman

BRUCE LEHMAN

*Attesting Officer*

*Commissioner of Patents and Trademarks*